US007342558B2

(12) United States Patent
Tachibana et al.

(10) Patent No.: US 7,342,558 B2
(45) Date of Patent: Mar. 11, 2008

(54) PLASMA DISPLAY PANEL DRIVE METHOD

(75) Inventors: Hiroyuki Tachibana, Osaka (JP); Naoki Kosugi, Kyoto (JP); Toshikazu Wakabayashi, Osaka (JP); Yasuaki Muto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 212 days.

(21) Appl. No.: 10/515,594

(22) PCT Filed: Mar. 23, 2004

(86) PCT No.: PCT/JP2004/003959

§ 371 (c)(1),
(2), (4) Date: Nov. 24, 2004

(87) PCT Pub. No.: WO2004/086342

PCT Pub. Date: Oct. 7, 2004

(65) Prior Publication Data

US 2005/0219156 A1 Oct. 6, 2005

(30) Foreign Application Priority Data

Mar. 24, 2003 (JP) ..... 2003-080303

(51) Int. Cl.
*G09G 3/28* (2006.01)

(52) U.S. Cl. ..... 345/63; 345/60; 345/66; 345/67; 345/68

(58) Field of Classification Search ..... 345/60–69, 345/204–215; 315/169.1–169.4
See application file for complete search history.

(56) References Cited

U.S. PATENT DOCUMENTS

| | | | | |
|---|---|---|---|---|
| 6,496,167 | B2 * | 12/2002 | Makino | 345/60 |
| 6,833,824 | B2 * | 12/2004 | Ide et al. | 345/66 |
| 7,116,289 | B2 * | 10/2006 | Yamada | 345/60 |
| 2001/0026254 | A1 * | 10/2001 | Ide et al. | 345/60 |
| 2004/0056606 | A1 * | 3/2004 | Ide et al. | 315/169.3 |
| 2004/0095294 | A1 * | 5/2004 | Yamada | 340/60 |
| 2004/0239593 | A1 * | 12/2004 | Yamada | 345/63 |

FOREIGN PATENT DOCUMENTS

| | | |
|---|---|---|
| JP | 5-313598 | 11/1993 |
| JP | 8-96714 | 4/1996 |
| JP | 9-245627 | 9/1997 |
| JP | 10-3281 | 1/1998 |
| JP | 2001-185034 | 7/2001 |

* cited by examiner

*Primary Examiner*—Vijay Shankar
(74) *Attorney, Agent, or Firm*—Wenderoth, Lind & Ponack, L.L.P.

(57) ABSTRACT

The initializing period of at least one of a plurality of sub-fields constituting one field is a selective initializing period for selectively initializing discharge cells in which a sustain discharge has occurred in the sustaining period of the preceding sub-field. In the sustaining period of the sub-field prior to the sub-field including the selective initializing period, voltage Vr is applied to a priming electrode (PRi) for causing a discharge between the priming electrode (PRi) and corresponding scan electrode (SCi) using the priming electrode (PRi) as a cathode.

4 Claims, 5 Drawing Sheets

PLASMA DISPLAY PANEL DRIVE METHOD

BACKGROUND OF THE INVENTION

1. Field of the Invention

The present invention relates to a method of driving a plasma display panel.

2. Description of the Related Art

A plasma display panel (hereinafter abbreviated as a PDP or a panel) is a display device having excellent visibility and featuring a large screen, thinness and a light weight. The systems of discharging a PDP include an alternating-current (AC) type and direct-current (DC) type. The electrode structures thereof include a three-electrode surface-discharge type and an opposite-discharge type. However, the current mainstream is an AC type three-electrode PDP, which is an AC surface-discharge type, because this type of PDP is suitable for higher definition and is easy to manufacture.

Generally, an AC type three-electrode PDP has a large number of discharge cells formed between a front panel and rear panel facing each other. In the front panel, a plurality of display electrodes, each comprising a pair of a scan electrode and a sustain electrode, are formed on a front glass substrate being parallel with each other. A dielectric layer and a protective layer are formed to cover these display electrodes. In the rear panel, a plurality of parallel data electrodes is formed on a rear glass substrate. A dielectric layer is formed on the data electrodes to cover them. Further, a plurality of barrier ribs is formed on the dielectric layer in parallel with the data electrodes. Phosphor layers are formed on the surface of the dielectric layer and the side faces of the barrier ribs. Then, the front panel and the rear panel which face each other are sealed together so that the display electrodes and data electrodes intersect with each other. A discharge gas is filled into an inside discharge space formed therebetween. In a panel structured as above, ultraviolet light is generated by gas discharge in each discharge cell. This ultraviolet light excites respective phosphors to emit R, G, or B color, to create a color display.

A general method of driving a panel is a so-called sub-field method: one field period is divided into a plurality of sub-fields and combination of light-emitting sub-fields provides gradation images for display. Now, each of the sub-fields has an initializing period, writing period, and sustaining period.

In the initializing period, all the discharge cells perform initializing discharge operation at a time to erase the history of wall electric charge previously formed in respective discharge cells and form a wall electric charge necessary for the subsequent writing operation. Additionally, this initializing discharge operation serves to generate priming (priming for discharge=excited particles) for causing stable writing discharge.

In the writing period, scan pulses are sequentially applied to scan electrodes, and write pulses corresponding to the signals of an image to be displayed are applied to data electrodes. Thus, selective writing discharge is caused between scan electrodes and corresponding data electrodes for selective formation of the wall electric charge.

In the subsequent sustaining period, a predetermined number of sustain pulses are applied between scan electrodes and corresponding sustain electrodes. Then, the discharge cells in which the wall electric charge is formed by the writing discharge are selectively discharged and light is emitted from the discharge cells.

In this manner, to properly display an image, selective writing discharge must securely be performed in the writing period. However, there are many factors in increasing discharge delay in the writing discharge: restraints of the circuitry inhibit the use of high voltage for write pulses; and phosphor layers formed on the data electrodes make discharge difficult. For these reasons, priming for generating stable writing discharge is extremely important.

However, the priming caused by discharge rapidly decreases as time elapses. This causes the following problems in the method of driving a panel described above. In writing discharge occurring a long time after the initializing discharge, priming generated in the initializing discharge is insufficient. This insufficient priming causes a large discharge delay and an unstable writing operation, thus degrading the image display quality. Additionally, when a long writing period is set for a stable writing operation, the time taken for the writing period is too long.

Proposed to address these problems are a panel and method of driving the panel in which auxiliary discharge electrodes are provided and discharge delay is minimized using priming caused by auxiliary discharge (see Japanese Patent Unexamined Publication No. 2002-297091, for example).

On the other hand, as a method of driving a panel, a so-called high-contrast driving method is proposed and put into actual use. In this method, the number of times of light emission in an initializing discharge unrelated to gradation representation is minimized to improve a contrast ratio (see Japanese Patent Unexamined Publication No. 2000-242224, for example).

In the above high-contrast driving method, one field is made of a plurality of sub-fields, each including an initializing period, writing period, and sustaining period. Initializing operations performed in the initializing period include an all-cell initializing operation for initializing all the discharge cells, and a selective initializing operation for selectively initializing the discharge cells in which discharge has occurred. The all-cell initializing operation is performed only in the initializing period in the first sub-field, for example. In the other sub-fields, the selective initializing operation is performed.

As described above, the initializing operation performed in most of the sub-fields in the plurality of sub-fields is the selective initializing operation for causing discharge only in the discharge cells in which a sustained discharge has occurred. Therefore, initializing light emission unrelated to gradation representation is only once in one field, i.e., the all-cell initializing operation in the first sub-field. Further, the light emission is weak light emission caused by ramp waveform voltage. For this reason, an image with high contrast can be obtained.

Future PDPs tend to have an increasing number of discharge cells necessitated by a larger screen size and higher definition, or an increasing number of sub-fields for achieving smoother image quality. With these trends, in spite of an increase in the number of writing operations, the time spent for the writing operation decreases. Thus, the time allocated for one writing operation tends to be shortened. For this reason, techniques of decreasing discharge delay in the writing operation are more and more important in the future. On the other hand, contrast must further be improved for more powerful image representation. These demands require integration of the following techniques: (1) achieving high contrast; and simultaneously achieving a high-speed writing operation.

The present invention addresses these problems and aims to provide a method of driving a plasma display panel capable of achieving a high contrast and a high-speed writing operation.

SUMMARY OF THE INVENTION

The method of driving a plasma display panel of the present invention includes applying, to priming electrodes, a voltage for causing discharge between the priming electrodes and scan electrodes using the priming electrodes as cathodes, prior to priming discharge in a writing period in a sub-field having a selective initializing period.

DETAILED DESCRIPTION OF THE INVENTION

A method of driving a plasma display panel in accordance with an exemplary embodiment of the present invention is described hereinafter with reference to the accompanying drawings.

Exemplary Embodiment

Figure 1:
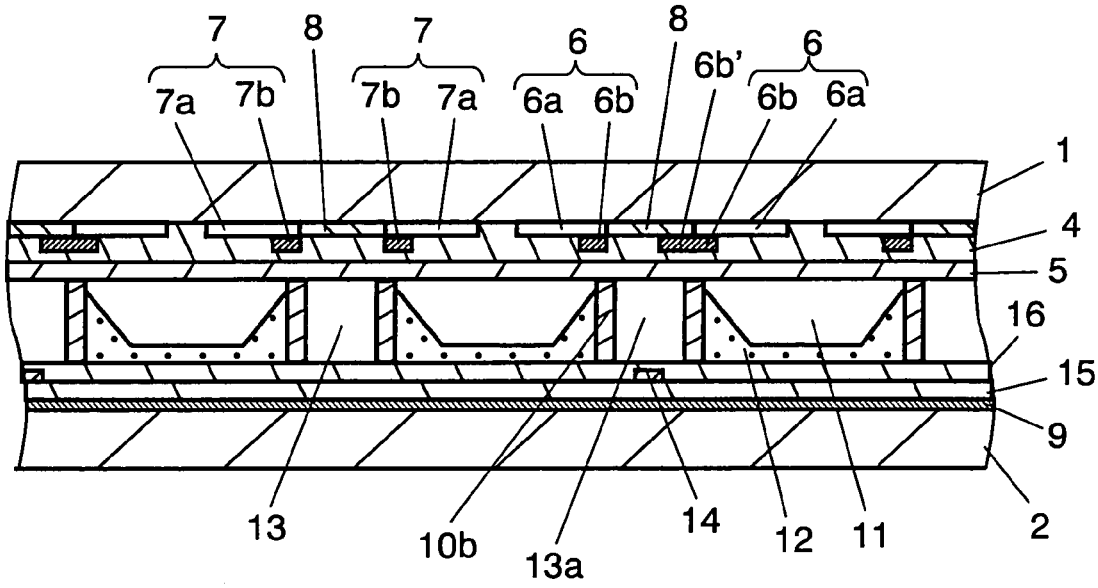
FIG. 1 is a sectional view showing an example of a panel used for an exemplary embodiment of the present invention.
Figure 2:
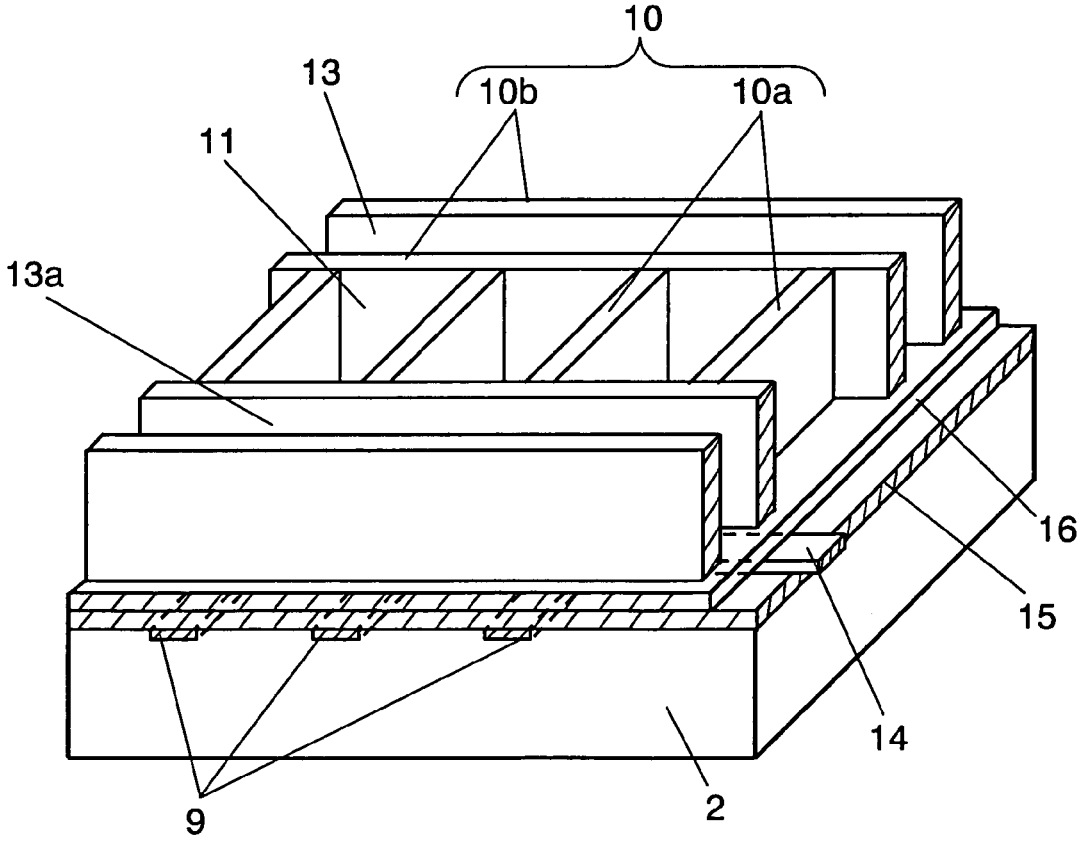
FIG. 2 is a schematic perspective view showing a structure of a rear substrate side of the panel.

FIG. 1 is a sectional view showing an example of a panel used for the exemplary embodiment of the present invention. FIG. 2 is a schematic perspective view showing the structure of the rear substrate side of the panel.

As shown in FIG. 1, front substrate 1 and rear substrate 2 both made of glass are arranged to face each other so as to sandwich a discharge space therebetween. A mixed gas of neon and xenon for radiating ultraviolet light by discharge is filled in the discharge space.

On front substrate 1, a plurality of pairs of a scan electrode 6 and a sustain electrode 7 are formed in parallel with each other. Scan electrodes 6 and sustain electrodes 7 are alternately arranged in pairs as follows: sustain electrode 7—scan electrode 6—scan electrode 6—sustain electrode 7, etc. Scan electrode 6 and sustain electrode 7 are made of transparent electrodes 6*a* and 7*a*, and metal buses 6*b* and 7*b* formed on transparent electrodes 6*a* and 7*a*, respectively. Now, between one scan electrode 6 and the other scan electrode 6, and one sustain electrode 7 and the other scan electrode 7, light-absorbing layers 8, each made of a black material, are provided. Projection 6*b*' of metal bus 6*b* in one of a pair of scan electrodes 6 projects onto light-absorbing layer 8. Dielectric layer 4 and protective layer 5 are formed to cover these scan electrodes 6, sustain electrodes 7, and light-absorbing layers 8.

On rear substrate 2, a plurality of data electrodes 9 are arranged in parallel with each other. Dielectric layer 15 is formed to cover these data electrodes 9. Further on the dielectric layer, barrier ribs 10 for partitioning the discharge space into discharge cells 11 are formed. As shown in FIG. 2, each barrier rib 10 is made of vertical walls 10*a* extending in parallel with data electrodes 9, and horizontal walls 10*b* for forming discharge cells 11 and forming clearance 13 between discharge cells 11. In every other one of clearances 13, priming electrode 14 is formed in the direction orthogonal to data electrodes 9, to form priming space 13*a*. On the surface of dielectric layer 15 corresponding to discharge cells 11 partitioned by barrier ribs 10 and the side faces of barrier ribs 10, phosphor layers 12 are provided. However, no phosphor layer 12 is formed on the side of clearances 13.

When front substrate 1 is faced and sealed with rear substrate 2, each projection 6*b*' of metal bus 6*b* in scan electrode 6 formed on front substrate 1 that projects onto light-absorbing layer 8 is positioned in parallel with corresponding priming electrode 14 on rear substrate 2 and faced therewith to sandwich priming space 13*a*. In other words, the panel shown in FIGS. 1 and 2 is structured to perform priming discharge between projections 6*b*' formed on the side of front substrate 1 and priming electrodes 14 formed on the side of rear substrate 2.

In FIGS. 1 and 2, dielectric layer 16 is further formed to cover priming electrodes 14; however, this dielectric layer 16 need not be formed necessarily.

Figure 3:
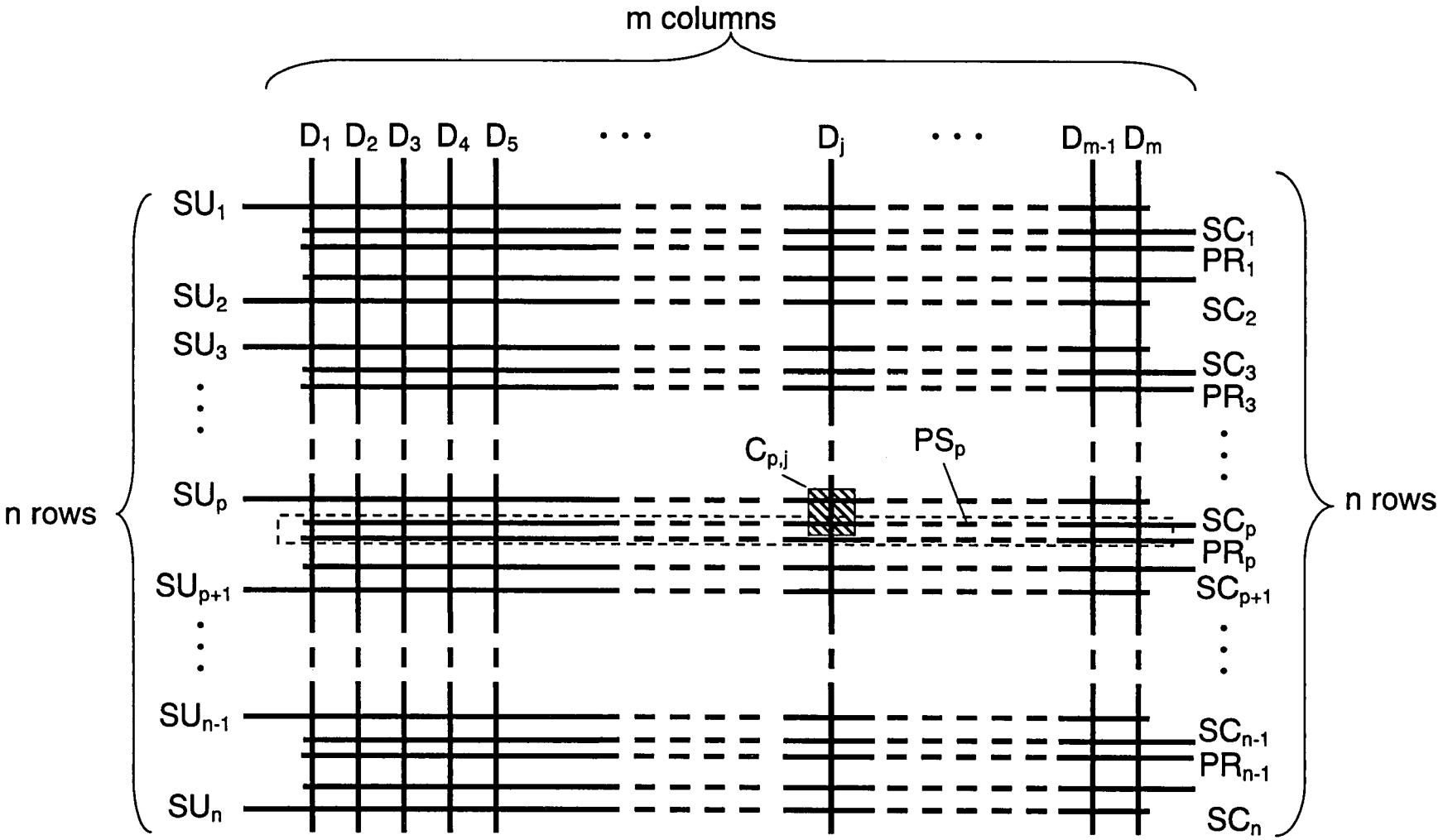
FIG. 3 is a diagram showing an arrangement of electrodes in the panel.

FIG. 3 is a diagram showing an arrangement of electrodes in the panel used for the exemplary embodiment of the present invention. M columns of data electrodes $D_1$ to $D_m$ (data electrodes 9 in FIG. 1) are arranged in the column direction. N rows of scan electrodes $SC_1$ to $SC_n$ (scan electrodes 6 in FIG. 1), and n rows of sustain electrodes $SU_1$ to $SU_n$ (sustain electrodes 7 in FIG. 1) are alternately arranged in pairs in the row direction like sustain electrode $SU_1$-scan electrode $SC_1$-scan electrode $SC_2$-sustain electrode $SU_2$, etc. In this embodiment, n/2 rows of priming electrodes $PR_1$, $PR_3$, etc. (priming electrode 14 in FIG. 1) are arranged to be faced with corresponding projections 6*b*' of scan electrodes $SU_1$, $SU_3$, etc. of the odd-numbered rows.

Thus, m×n discharge cells $C_{ij}$ (discharge cells 11 in FIG. 1), each including a pair of scan electrode $SC_i$ and sustain electrode $SU_i$ (i=1 to n) and one data electrode $D_j$ (j=1 to m), are formed in the discharge space. N/2 rows of priming spaces $PS_p$ (priming space 13*a* in FIG. 1), each including projection 6*b*' of scan electrode $SC_p$ (p=odd number) and priming electrode $PR_p$, are formed.

Next, a driving waveform for driving the panel and timing of the driving waveform is described.

Figure 4:
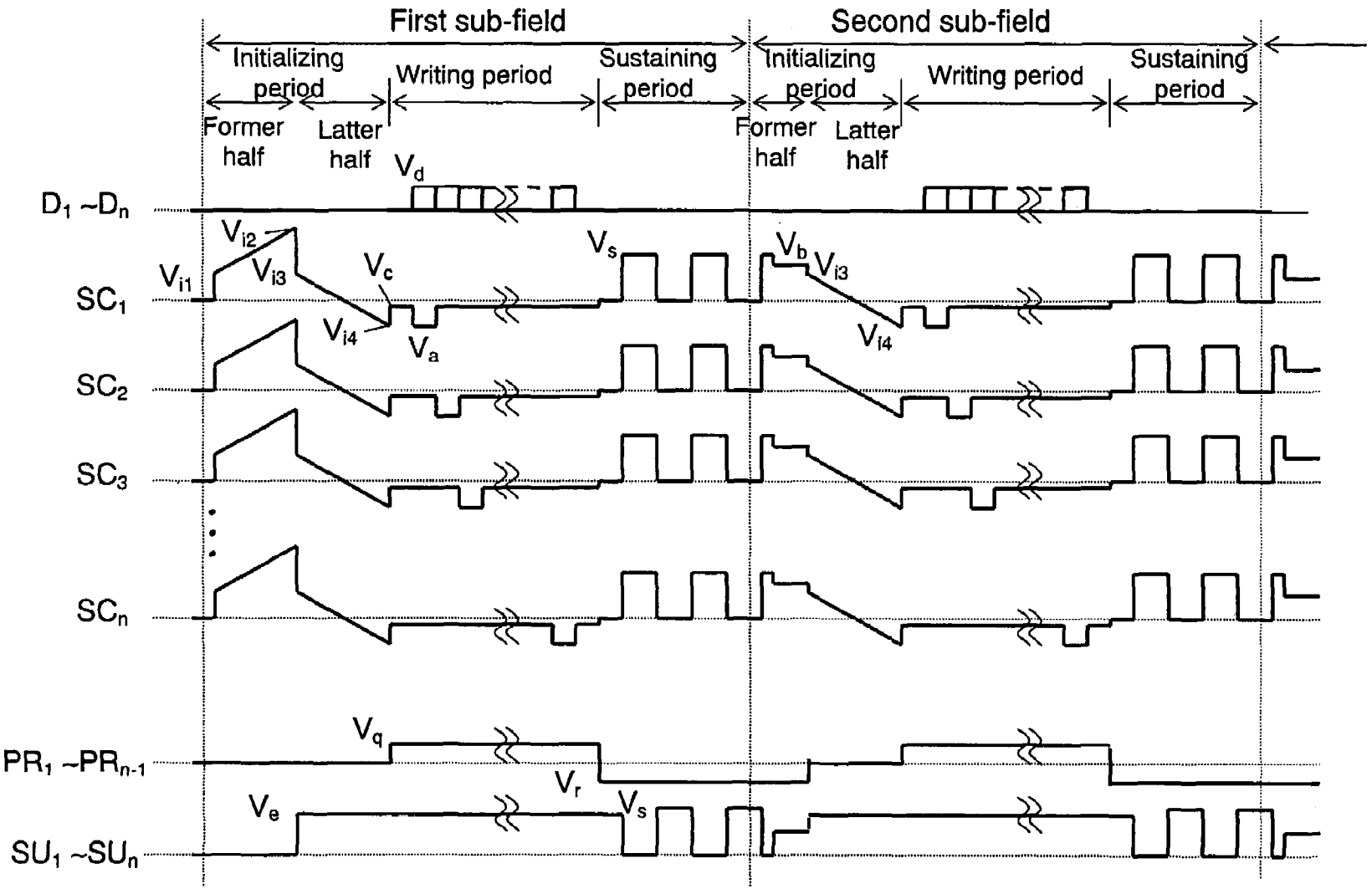
FIG. 4 is a diagram showing a driving waveform in a method of driving the panel.

FIG. 4 is a diagram showing a driving waveform in the method of driving the panel used for the exemplary embodiment of the present invention. In this embodiment, one field period is made of a plurality of sub-fields, each including an initializing period, writing period, and sustaining period. The initializing period in the first sub-field is an all-cell initializing period for initializing all the discharge cells related to image display. In the initializing periods in the second sub-field or after, a selective initializing operation for selectively initializing the discharge cells in which sustain discharge has occurred in the preceding sub-field is performed. Descriptions are given on the basis of these ideas.

In the former half of the initializing period in the first sub-field, each of data electrodes $D_1$ to $D_m$, sustain electrode $SU_1$ to $SU_n$, and priming electrodes $PR_1$ to $PR_{n-1}$ is held at 0 (V). Applied to each of scan electrodes $SC_1$ to $SC_n$ is a ramp waveform voltage gradually increasing from a voltage of $V_{i1}$ not larger than discharge-starting voltage across the scan electrodes and sustain electrodes $SU_1$ to $SU_n$ to a voltage of $V_{i2}$ exceeding the discharge-starting voltage.

While the ramp waveform voltage increases, first weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_{n-1}$. Thus, negative wall voltage accumulates on scan electrodes $SC_1$ to $SC_n$, and positive wall voltage accumulates on data electrodes $D_1$ to $D_m$, sustain electrodes $SU_1$ to $SU_n$, and priming electrodes $PR_1$ to $PR_{n-1}$. Now, the wall voltage on the electrodes is the voltage generated by the wall charge accumulating on the dielectric layers covering the electrodes.

In the latter half of the initializing period in the first sub-field, each of sustain electrode $SU_1$ to $SU_n$ is held at a positive voltage of Ve. Applied to each of scan electrodes $SC_1$ to $SC_n$ is a ramp waveform voltage gradually decreasing from a voltage of $V_{i3}$ not larger than discharge-starting voltage across the scan electrodes and sustain electrodes $SU_1$ to $SU_n$ to a voltage of $V_{i4}$ exceeding the discharge-starting voltage. During this application of the ramp voltage, second weak initializing discharge occurs between scan electrodes $SC_1$ to $SC_n$, and sustain electrodes $SU_1$ to $SU_n$, data electrodes $D_1$ to $D_m$, and priming electrodes $PR_1$ to $PR_{n-1}$. Then, the negative wall voltage on scan electrodes $SC_1$ to $SC_n$ and the positive wall voltage on sustain electrodes $SU_1$ to $SU_n$ are weakened. The positive wall voltage on data electrodes $D_1$ to $D_m$ is adjusted to a value appropriate for writing operation. The positive wall voltage on priming electrodes $PR_1$ to $PR_{n-1}$ is also adjusted to a value appropriate for priming operation. Thus, the all-cell initializing operation for initializing all the discharge cells related to image display is completed.

In the writing period, scan electrodes $SC_1$ to $SC_n$ are initially held at a voltage of Vc. Then, a voltage of Vq substantially equal to voltage change Vc-$V_{i4}$ is applied to priming electrodes $PR_1$ to $PR_{n-1}$.

Next, scan pulse Va is applied to scan electrode $SC_1$ of the first row. Then, the potential difference between priming electrode $PR_1$ and projection 6*b*' of scan electrode $SC_1$ is addition of Vq-Va and the wall voltage on priming electrode $PR_1$. Thus, the potential difference exceeds the discharge-starting voltage and priming discharge occurs. The priming diffuses inside of discharge cells $C_{1,1}$ to $C_{1,m}$ in the first row and discharge cells $C_{2,1}$ to $C_{2,m}$ in the second row. Because the priming space $PS_1$ is structured to easily discharge as described above, high-speed and stable priming discharge with a small discharge delay can obtained. This discharge accumulates positive wall voltage on priming electrode $PR_1$.

At the same time, positive write pulse voltage Vd is applied to data electrode $D_k$ (k being an integer ranging from 1 to m) corresponding to the signal of an image to be displayed in the first row, among data electrodes $D_1$ to $D_m$. Then, discharge occurs at the intersection of data electrode $D_k$ to which write pulse voltage Vd has been applied and scan electrode $SC_1$. This discharge develops to the discharge between sustain electrode $SU_1$ and scan electrode SCI in corresponding discharge cell $C_{1,k}$. Then, positive voltage accumulates on scan electrode $SC_1$ and negative voltage accumulates on sustain electrode $SU_1$ in discharge cell $C_{1,k}$. Thus, the writing operation in the first row is completed.

Now, in the writing operation in the first row, writing is performed and the priming discharge is caused with scanning of scan electrode $SC_1$ of the first row. The writing discharge in discharge cell $C_{1,k}$ occurs with the priming supplied from the priming discharge that has occurred between scan electrode $SC_1$ and priming electrode $PR_1$. For this reason, although there is a delay in starting the priming, stable discharge with a small discharge delay can be obtained after the supply of the priming.

Next, scan pulse voltage Va is applied to scan electrode $SC_2$ of the second row. At the same time, positive write pulse voltage Vd is applied to data electrode $D_k$ corresponding to the signal of the image to be displayed in the second row, among data electrodes $D_1$ to $D_m$. Then, discharge occurs at the intersection of data electrode $D_k$ and scan electrode $SC_2$. This discharge develops to the discharge between sustain electrode $SU_2$ and scan electrode $SC_2$ in corresponding discharge cell $C_{2,k}$. Then, positive voltage accumulates on scan electrode $SC_2$ and negative voltage accumulates on sustain electrode $SU_2$ in discharge cell $C_{2,k}$. Thus, the writing operation in the second row is completed.

Now, the writing operation in discharge cell $C_{2,k}$ of the second row is performed with sufficient priming already supplied from the priming discharge that has occurred between scan electrode $SC_1$ and priming electrode $PR_1$. For this reason, stable discharge with an extremely small discharge delay in the writing discharge can be obtained.

In the similar manner, the writing operations are performed in discharge cells including $C_{n,k}$ and the writing operations are completed.

In the sustaining period, after scan electrodes $SC_1$ to $SC_n$ and sustain electrodes $SU_1$ to $SU_n$ are reset to 0 (V) once, a negative voltage of Vr is applied to priming electrodes $PR_1$ to $PR_{n-1}$. Thereafter, a positive sustain pulse voltage of Vs is applied to scan electrodes $SC_1$ to $SC_n$. At this time, in the voltage on scan electrode $SC_i$ and sustain electrode $SU_i$ in discharge cell $C_{i,j}$ in which writing discharge has occurred, the wall voltage accumulating on scan electrode $SC_i$ and sustain electrode $SU_i$ is added to sustain pulse voltage Vs. For this reason, the voltage exceeds the discharge-starting voltage and sustain discharge occurs. In a similar manner, by alternately applying sustain pulses to scan electrodes $SC_1$ to $SC_n$ and sustain electrodes $SU_1$ to $SU_n$, sustain discharge operations are successively performed in discharge cell $C_{i,k}$ in which the writing discharge has occurred, the number of times of sustain pulses.

At this time, discharge also occurs between priming electrode $PR_i$ and scan electrode $SC_i$ corresponding to priming electrode $PR_i$, using priming electrode $PR_i$ as a cathode. Thus, wall charge having a value depending on potential difference Vs−Vr accumulates on priming electrode $PR_i$. At this time, at the larger difference between voltage Vs and voltage Vr, the larger positive wall voltage accumulates on priming electrode $PR_i$.

In the former half of the initializing period in the second sub-field, a pulse with a small width that increases from 0 (V) to voltage Vs once and promptly decreases to voltage Vb is applied to scan electrodes $SC_1$ to $SC_n$. At the same time, a pulse having a small width that decreases from voltage Vs to 0 (V) once and promptly increases to voltage Vb is applied to sustain electrodes $SU_1$ to $SU_n$. In the latter half of the initializing period, application of a ramp waveform voltage gradually decreasing voltage $V_{i3}$ to voltage $V_{i4}$ weakens the excessive wall charge. This performs initializing discharge only in the discharge cells in which sustain discharge has occurred, erases the wall charge accumulated by the sustain discharge, and adjusts the positive wall voltage on data electrodes $D_1$ to $D_m$ to a value appropriate for writing operation and the positive wall voltage on priming electrodes $PR_1$ to $PR_{n-1}$ to a value appropriate for priming operation.

The operations in the subsequent writing and sustaining periods are the same as those in the first sub-field, and thus the description thereof is omitted.

As described above, the initializing operation performed in the second sub-field or after is selective initializing operation for causing discharge only in the discharge cells in which sustain discharge has occurred. Therefore, light emission unrelated to gradation representation is only once in one field, i.e., the all-cell initializing operation in the first sub-field. Further, because the light emission is weak light emission caused by the ramp waveform voltage, an image with high contrast can be displayed.

Further, unlike the writing discharge depending only on the priming in the initializing discharge in accordance with a conventional driving method, the writing discharge of the method of driving a panel in accordance with this embodiment of the present invention is performed with sufficient priming supplied from the priming discharge that has occurred during or immediately before the writing operation in respective discharge cells. This can achieve high-speed and stable writing discharge with a small discharge delay, and display a high-quality image.

Additionally, electrodes in priming spaces 13*a* are priming electrodes 14 and scan electrodes 6 only. This also gives an advantage of stable action of the priming discharge itself because the priming discharge is unlikely to cause other unnecessary discharge, e.g., incorrect discharge involving the sustain electrodes.

Now, to give the reason why the present invention enables high-speed writing while achieving high contrast, the above operations are described again from the viewpoint of wall charge on the priming electrodes.

First, in the former half of the initializing period in the first sub-field, excessive and unnecessary positive wall voltage is formed on priming electrodes $PR_1$ to $PR_{n-1}$ once. In the latter half of the initializing period, the excessive portion of the wall voltage is reduced and adjusted to a value appropriate for priming operation.

In the writing period, the adjusted positive wall voltage is used to cause priming discharge. This discharge extinguishes the positive wall voltage on priming electrodes $PR_1$ to $PR_{n-1}$.

In the sustaining period, negative voltage Vr applied to priming electrodes $PR_1$ to $PR_{n-1}$ is added to voltage Vs applied to scan electrodes $SC_1$ to $SC_n$, and strong discharge occurs using priming electrodes $PR_1$ to $PR_{n-1}$ as cathodes. Thus, excessive positive wall voltage is formed on priming electrodes $PR_1$ to $PR_{n-1}$ again.

In the former half of the initializing period in the second sub-field, because a potential difference larger than Vs−Vr is not applied across scan electrodes $SC_1$ to $SC_n$ and priming electrodes $PR_1$ to $PR_{n-1}$, no discharge occurs therebetween. However, in the sustaining period immediately before the former half of the initializing period, excessive positive wall voltage is formed on priming electrodes $PR_1$ to $PR_{n-1}$. For this reason, in the subsequent latter half of the initializing period, the excessive portion of the wall voltage is reduced and adjusted to a value of the wall voltage appropriate for the subsequent priming operation.

As described above, because no discharge occurs to form excessive positive wall voltage on priming electrodes $PR_1$ to $PR_{n-1}$ in the selective initializing period, excessive positive wall voltage must be formed on priming electrodes $PR_1$ to $PR_{n-1}$ before the latter half of the selective initializing operation. Therefore, as described above, a negative voltage is applied to priming electrodes $PR_1$ to $PR_{n-1}$ to cause strong discharge between the priming electrodes and corresponding scan electrodes $SC_1$ to $SC_n$ using priming electrodes $PR_1$ to $PR_{n-1}$ as cathodes and to form excessive positive wall voltage on priming electrodes $PR_1$ to $PR_{n-1}$, in the sustaining period of the sub-field prior to a sub-field including a selective initializing period. This can achieve high contrast and high-speed writing at the same time.

Figure 5:
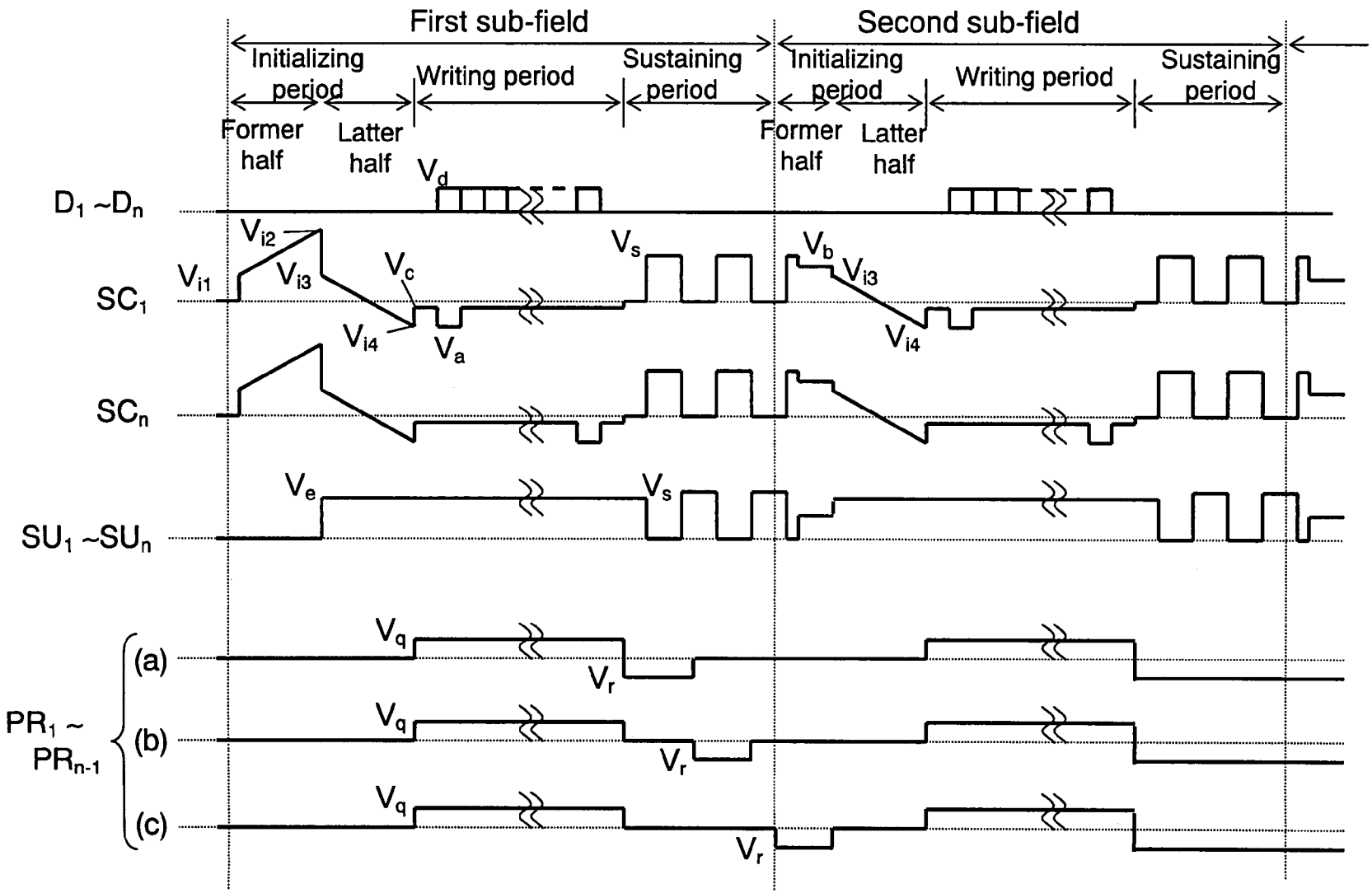
FIG. 5 is a diagram showing another driving waveform in a method of driving the panel.

FIG. 5 shows another waveform in the method of driving the panel used for the exemplary embodiment of the present invention. In FIG. 5 (*a*), voltage Vr for causing discharge using priming electrodes $PR_1$ to $PR_{n-1}$ as cathodes is applied to priming electrodes $PR_1$ to $PR_{n-1}$ only in the beginning of the sustaining period in the sub-field prior to a sub-field including a selective initializing period. In this case, application of first sustain pulse voltage Vs to scan electrodes $SC_1$ to $SC_n$ causes discharge using priming electrodes $PR_1$ to $PR_{n-1}$ as cathodes. In FIG. 5 (*b*), voltage Vr is applied to priming electrodes $PR_1$ to $PR_{n-1}$ in an intermediate portion of the sustaining period. In this case, application of sustain pulse voltage Vs to scan electrodes $SC_1$ to $SC_n$ causes discharge using priming electrodes $PR_1$ to $PR_{n-1}$ as cathodes. In FIG. 5 (*c*), voltage Vr is applied to priming electrodes $PR_1$ to $PR_{n-1}$ in the former half of the selective initializing period. In this case, application of pulse voltage Vs having a small width to scan electrodes $SC_1$ to $SC_n$ causes discharge using priming electrodes $PR_1$ to $PR_{n-1}$ as cathodes.

Even application of driving waveforms shown in FIGS. 5 (*a*), (*b*), or (*c*), or similar ones to priming electrodes $PR_1$ to $PR_{n-1}$ can provide effects similar to those of the driving method in accordance with the exemplary embodiment of the present invention.

Incidentally, because respective electrodes of an AC type PDP are surrounded by the dielectric layers and insulated from the discharge space. For this reason, direct-current components make no contribution to discharge itself. Therefore, of course, even the use of a waveform in which direct-current components are added to the driving waveform of the exemplary embodiment of the present invention can provide similar effects.

In the description of this exemplary embodiment, in a plurality of sub-fields constituting one field, the first sub-field includes an all-cell initializing period, and the second sub-field or after includes a selective initializing period. However, the present invention can be implemented even when one field includes arbitrary combinations of sub-fields each having an all-cell initializing period and sub-fields each having a selective initializing period.

Figure 6:
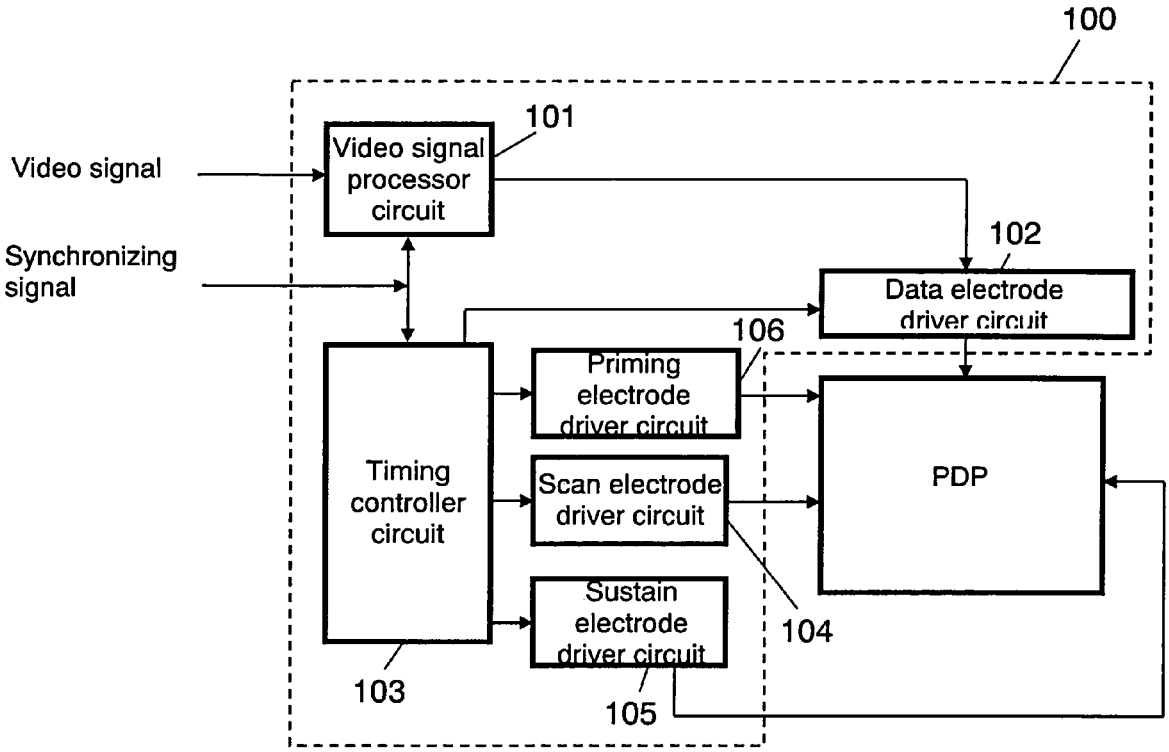
FIG. 6 is diagram showing an example of a circuit block of a driver for implementing the method of driving the panel.

FIG. 6 is a diagram showing an example of a circuit block of a driver for implementing the method of driving the panel used for the exemplary embodiment. Driver 100 of the exemplary embodiment of the present invention includes: video signal processor circuit 101, data electrode driver circuit 102, timing controller circuit 103, scan electrode driver circuit 104 and sustain electrode driver circuit 105, and priming electrode driver circuit 106. A video signal and synchronizing signal are fed into video signal processor circuit 101. Responsive to the video signal and synchronizing signal, video signal processor circuit 101 outputs a sub-field signal for controlling whether or not to light each sub-field, to data electrode driver circuit 102. The synchronizing signal is also fed into timing controller circuit 103. Responsive to the synchronizing signal, timing controller circuit 103 outputs a timing control signal to data electrode driver circuit 102, scan electrode driver circuit 104, sustain electrode driver circuit 105, and priming electrode driver circuit 106.

Responsive to the sub-field signal and the timing control signal, data electrode driver circuit 102 applies a predetermined driving waveform to data electrodes 9 (data electrodes $D_1$ to $D_m$ in FIG. 3) in the panel. Responsive to the timing control signal, scan electrode driver circuit 104 applies a predetermined driving waveform to scan electrodes 6 (scan electrodes $SC_1$ to $SC_n$ in FIG. 3) in the panel. Responsive to the timing control signal, sustain electrode driver circuit 105 applies a predetermined driving waveform to sustain electrodes 7 (sustain electrodes $SU_1$ to $SU_n$ in FIG. 3) in the panel. Responsive to the timing control signal, priming electrode driver circuit 106 applies a predetermined driving waveform to priming electrodes 14 (priming electrodes $PR_1$ to $PR_{n-1}$ in FIG. 3) in the panel. Necessary electric power is supplied to data electrode driver circuit 102, scan electrode driver circuit 104, sustain electrode driver circuit 105, and priming electrode driver circuit 106 from a power supply circuit (not shown).

The above circuit block can constitute a driver for implementing the method of driving the panel of the exemplary embodiment.

As described above, the present invention can provide a method of driving a plasma display panel capable of achieving high contrast and stable and high-speed writing operation.

INDUSTRIAL APPLICABILITY

As described above, the method of driving a plasma display panel of the present invention can achieve high contrast and stable and high-speed writing operation. Thus, the present invention is useful as a method of driving a plasma display panel.

The invention claimed is:

1. A method of driving a plasma display panel including a plurality of scan electrodes and a plurality of sustain electrodes arranged in parallel with each other, a plurality of data electrodes arranged in a direction intersecting the scan electrodes and a plurality of priming electrodes arranged in parallel with the scan electrodes, the priming electrodes for generating a priming discharge between the priming electrodes and the corresponding scan electrodes, in which one field period includes a plurality of sub-fields, each sub-field including an initializing period, a writing period, and a sustaining period, the method comprising:

providing at least one sub-field which includes a selective initializing period for selectively initializing discharge cells in which a sustain discharge has occurred in a sustaining period of a preceding sub-field, in the plurality of sub-fields; and applying, to the priming electrodes, a voltage for causing a discharge between the priming electrodes and the corresponding scan electrodes using the priming electrodes as cathodes, in a period prior to a writing period in the sub-field which includes the selective initializing period.

2. The method of driving a plasma display panel of claim 1, wherein the period is in a sustaining period of a sub-field prior to the sub-field including the selective initializing period.

3. The method of driving a plasma display panel of claim 1, wherein the period is in the selective initializing period of the sub-field including the selective initializing period.

4. The method of driving a plasma display panel of claim 1, wherein said applying comprises applying, in the writing period, a voltage of a positive polarity to the priming electrodes.

* * * * *